United States Patent [19]

Berger et al.

[11] 4,132,525

[45] Jan. 2, 1979

[54] PROCESS FOR DYEING MATERIALS WHICH CONTAIN SYNTHETIC FIBRES USING POLYADDUCTS OF PROPYLENE OXIDE AND POLYHYDRIC ALCOHOLS

[75] Inventors: Alfred Berger, Reinach; Hans-Ulrich Berendt, Allschwil, both of Switzerland

[73] Assignee: Ciba-Geigy Corporation, Ardsley, N.Y.

[21] Appl. No.: 785,897

[22] Filed: Apr. 8, 1977

Related U.S. Application Data

[63] Continuation of Ser. No. 577,129, May 13, 1975, abandoned.

[51] Int. Cl.[2] ..... D06P 5/08; D06P 1/653; C09B 67/00; D06P 3/82

[52] U.S. Cl. ..... 8/173; 8/89 R; 8/26; 8/21 C; 8/21 B; 8/21 A; 8/1 XB

[58] Field of Search ..... 8/93, 173, 89 R

[56] References Cited

U.S. PATENT DOCUMENTS

| | | | |
|---|---|---|---|
| 2,901,311 | 8/1959 | Nusslein et al. | 8/173 |
| 2,965,678 | 12/1960 | Sundberg et al. | 8/173 |
| 3,173,877 | 3/1965 | Jackson | 252/89 R |
| 3,706,525 | 12/1972 | Blackwell et al. | 8/93 |
| 3,713,769 | 1/1973 | Beal et al. | 8/173 |
| 3,775,056 | 11/1973 | Grossman et al. | 8/173 |
| 3,963,432 | 6/1976 | Hauxwell et al. | 8/173 |

FOREIGN PATENT DOCUMENTS

| | | | |
|---|---|---|---|
| 2318631 | 10/1973 | Fed. Rep. of Germany. | |
| 907465 | 5/1965 | Japan | 8/21 A |
| 1161475 | 8/1969 | United Kingdom | 8/173 |

*Primary Examiner*—Joseph L. Schofer
*Assistant Examiner*—Maria S. Tungol
*Attorney, Agent, or Firm*—Edward McC. Roberts

[57] ABSTRACT

Process for dyeing materials which contain synthetic fibres with dyes that are sparingly soluble to insoluble in water, in the presence of dyeing auxiliaries which are polyadducts of propylene oxide and a polyhydric aliphatic alcohol of at least 2 carbon atoms, wherein said adducts are soluble in water and contain sulphonic acid groups.

The process of present invention is especially suitable for dyeing linear polyester fibres wherein level and strong dyeings are obtained which are in addition characterized by good fastness to rubbing.

14 Claims, No Drawings

PROCESS FOR DYEING MATERIALS WHICH CONTAIN SYNTHETIC FIBRES USING POLYADDUCTS OF PROPYLENE OXIDE AND POLYHYDRIC ALCOHOLS

This is a continuation of application Ser. No. 577,129 filed on May 13, 1975 now abandoned.

The present invention provides a novel process for dyeing materials which contain synthetic fibres, the dye liquor suitable for carrying out this process, and the fibrous materials which are dyed according to the novel process.

When dyeing textile materials with dyes which are insoluble or sparingly soluble in water, for example by the high temperature circulation process, dispersion problems often occur which are due to an inadequate dispersion of the dyes in the dye liquors. Unlevel dyeings of poor fastness, above all poor fastness to rubbing, are consequently obtained. Such deficiencies also become apparent inter alia in the dyeing of synthetic fibres, especially the linear polyester fibres, with disperse dyes.

In order to stabilise dispersions of dyes which are sparingly soluble in water, it is generally known to add certain assistants to the dyebaths, e.g. condensation products of napthalenesulphonic acid and formaldehyde or the alkali salts thereof, oxethylated fatty alcohols or lignin sulphonates.

However, these products have either only dispersing or levelling properties. It is therefore well-nigh only possible to attain both effects simultaneously by using mixtures of different assistants. Also many dispersants adversely affect the dispersing and dyeing procedure on account of their pronounced tendency to foam.

The invention provides a noval process which makes it possible to obtain level dyeings which are fast to rubbing when dyeing materials which contain synthetic fibres with dyes which are sparingly soluble to insoluble in water.

The novel process consists in dyeing the fibres in the presence of a polyadduct of polypropylene oxide and a polyhydric aliphatic alcohol of at least 2 and preferably 3 to 6 carbon atoms which is soluble in water and contains sulphonic acid groups.

With the aid of these polyadducts it is now possible to eliminate the disadvantages described hereinbefore which occur when dyeing organic synthetic fibres, especially polyester fibres, with disperse dyes without addition of assistants or with the previous additives. The advance in the art attained according to the invention resides primarily in the excellent stabilising action of the polyadducts on the dyestuff dispersion, so that during the entire dyeing procedure there occurs neither an aggregation nor a precipitation of the dye.

A further advantage of these compounds used as levelling agents and dispersants resides in their negligible foaming tendency. There is consequently no danger of foam specks forming on the dyeings and a more rapid penetration of the goods and an increase in the flow velocity in the dyeing machinery are thereby ensured.

The polyadducts used according to the invention are, for example, adducts of propylene oxide and polyhydric aliphatic alcohols of at least 2, preferably 3 to 6, carbon atoms, which are converted into an acid ester with a sulphonated organic, preferably aliphatic, mono- or dicarboxylic acid of 3 to 6 carbon atoms, e.g. propionic acid or succinic acid, but preferably with an inorganic sulphation agent, especially sulphuric acid or sulphaminic acid.

Suitable polyhydric alcohols as defined herein are those containing at least 2 hydroxy groups, for example, alkylene diols with an alkylene radical of 2 to 6 carbon atoms, e.g. ethylene glycol, 1,3- or 1,2-propylene glycol or 1,5-pentane diol, glycerol or trimethylol propane. It is preferred to use aliphatic alcohols which contain 3 carbon atoms and 2 or 3 hydroxy groups.

Sulphated adducts as defined herein with an average molecular weight of 1000 to 6000, preferably 2000 to 3500, have for example proved particularly effective for the use according to the present invention. Of these, adducts which are derived from propylene glycol or glycerol are especially suitable.

The polyadducts containing groups to be used according to the invention can be used as free acid or preferably in the form of their alkali metal or ammonium salts. Alkali metal salts are in particular the sodium and potassium salts, and ammonium salts are the ammonium, trimethylammonium, monoethanolammonium, diethanolammonium and triethanolammonium salts. Preferably the polyadducts are used as ammonium sulphate salts.

Typical examples of the polyadducts which contain sulphonic acid groups used according to the invention are the reaction produt obtained by reaction of polypropylene glycol and sulphamic acid, the polypropylene glycol having an average molecular weight of 1000 to 3500, preferably 2000, and the sulphated adducts obtained from glycerol or trimethylol propane and propylene oxide, the polyadducts having an average molecular weight of 2000 to 6000, preferably 3000 or 2500.

A further example of a polyadduct which contains sulphonic acid groups is the sulpho-succinic acid half ester of a polyadduct obtained by addition of propylene oxide to glycerol, said half ester having an average molecular weight of about 4000.

The amount of polypropyleneoxy adducts which contain sulphonic acid groups used varies according to the present invention between 0.1 and 5 g, preferably 0.5 to 2 g, per liter of aqueous dye liquor.

It is often desirable to incorporate an antifoaming agent into the aqueous solution of the polyadduct in order to improve the properties of the dyebath to which the dispersant is added and sometimes also to increase the migration of the dye. A satisfactory type of antifoaming agent is a silicone emulsion, for example a 5 to 10% aqueous silicone emulsion, which can also be used in combination with higher alcohols of 4 to 22 carbon atoms, especially with 2-ethyl-hexanol. The most suitable antifoaming agents, however, are water-insoluble alkyleneoxy adducts of higher alcohols, for example the adduct of stearyl alcohol and 1 mole of ethylene oxide, as well as esters of aliphatic dicarboxylic acids andd higher alcohols or the higher alcohols alone, e.g. butyl alcohol or 2-ethylhexanol. Adipic acid di-2-ethylhexyl ester and methyl polysiloxanes have proved to be the most suitable antifoaming agents.

The amount of antifoaming agent used can be e.g. 0.5 percent by weight, advantageously however at least 10 percent by weight, preferably 15 to 60 percent by weight, based on the weight of the polyadduct.

It is also possible to add water-miscible alcohols to the solution of the polyadduct. Particularly suitable for this purpose are lower aliphatic alcohols, like alkanols, e.g. ethyl alcohol, n-propyl and isopropyl alcohol, tert. butyl alcohol, alkylene glycols, e.g. ethylene glycol and 2,5-hexane diol and the lower monoalkyl ethers thereof, as well as mixtures thereof.

By dyes which are insoluble or sparingly soluble in water are meant in the context of the invention vat dyes, pigment dyes, and, above all, disperse dyes which have affinity for fibres, i.e. those which exhaust onto textile synthetic fibres.

These dyes can belong to the most widely varying classes, e.g. acridone, nitro, methine and polymethine dyes, styryl and azostyryl dyes, xanthene dyes, oxazine dyes, aminonaphthoquinone dyes, cumarin dyes and especially anthraquinone dyes and azo dyes, such as monazo and disazo dyes.

According to the invention, it is also possible to use mixtures of such dyes.

The process according to the invention is also suitable for whitening undyed textile materials with fluorescent brighteners which are sparingly soluble in water. These can belong to any class of fluorescent brightener. In particular they are stilbene compounds, cumarins, benzocumarins, pyrazines, pyrazolines, oxazines, triazolyl, benzoxazolyl, benzofuran or benzimidazolyl compounds and naphthalic amides.

The amount of dye which is added to the liquor in the process according to the invention depends on the desired colour strength; amounts of 0.01 to 10 percent by weight, based on the weight of the fibrous material, have proved effective as a rule.

Fibrous materials which can be dyed acccording to the invention are cellulose ester fibres, such as cellulose 2½-acetate and cellulose triacetate fibres, synthetic polyamide fibres, e.g. those from ε-caprolactam, from adipic acid and hexamethylene diamine, from ω-aminoundecanoic acid, polyurethane, polyolefin fibres, e.g. polypropylene fibres, polyacrylonitrile fibres, including modacryl fibres, and, above all, linear polyester fibres. By linear polyester fibres are meant synthetic fibres which are obtained by condensation of terephthalic acid with ethylene glycol or of isophthalic acid or terephthalic acid with 1,4-bis-(hydroxymethyl)-cyclohexane, as well as copolymers of terephthalic and isophthalic acid and ethylene glycol. The fibrous materials can also be used as blends of polyacrylonitrile/polyester, polyamide/polyester, polyester/viscose and polyester/wool.

The fibrous material can moreover be in the most widely different stages of processing, e.g. in the form of flocks, piece goods, such as wovens and knitted fabrics, hanks, wound packages, nonwovens, textile floor coverings or tufted carpets.

Dyeing is effected advantageously from an aqueous liquor by the exhaustion process. Linear polyester fibres are dyed preferably by the high temperature process in sealed and desirably also pressure-resistant apparatus at temperatures of over 100° C, preferably between 110° and 140° C, and optionally under presssure. Examples of suitable sealed vessels are circulation machines like cheese dyeing and beam dyeing machines, winch becks, jet or drum dyeing machines, paddles or jiggers. The liquor ratio can accordingly be chosen within a wide range, e.g. 1:1 to 1:100, preferably 1:10 to 1:50. The dyeing of the linear polyester fibres can also be carried out at temperatures below 100° C, e.g. in the temperature range of 75° to 98° C, in the presence of the customary carriers, for example phenylphenols, polychlorobenzenes, xylenes, toluenes, naphthalenes or diphenyl. Cellulose 2 ½-acetate fibres are dyed preferably at temperatures of 80°–85° C, while cellulose triacetate fibres are dyed with advantage at the boiling point (98° C) of the aqueous bath.

The use of carries is superfluous when dyeing cellulose 2 ½-acetate or polyamide fibres.

When manufacturing the dye liquors, it is desirable to start from the aqueous solutions of the polyadduct and to add to these the appropriate assistants, such as antifoaming agents and lower alcohols. The liquors can contain mineral acids, such as sulphuric acid or preferably phosphoric acid, organic acids, desirably lower aliphatic carboxylic acids, e.g. formic, acetic or oxalic acid and/or salts, such as ammonium acetate, ammonium sulphate or sodium acetate. The acids are used primarily for adjusting the pH of the liquors according to the invention. The pH is normally 4 to 8, preferably 4.5 to 6.5.

The textile material is put into the liquor, which can have a temperature of 40° to 70° C, and is treated for 5 to 15 minutes at this temperature. Afterwards the dye and optionally the carrier is added and the temperature of the liquor is raised in order to dye for 50 to 100 minutes in the given temperature range.

The dyed material is subsequently rinsed and dried in the usual way. A reductive aftertreatment is normally not necessary. As a rule the goods remain stationary in the dyeing apparatus and the liquor circulates through them. It is important that there is not only a fine dispersion of the dye initially, but also that the degree of dispersion is maintained during the entire dyeing procedure. It is common knowledge that certain disperse dyes, above all under the conditions of high temperature dyeing, tend to become converted into a less fine form. The consequence of this is that the dye no longer exhausts onto the fibre and settles on the surface of the good. Such dyestuff agglomerations and precipitations can be avoided especially well with the anionic polyadducts to be used according to the invention.

According to the invention, the synthetic fibrous material can also be dyed continuously, i.e. by impregnation with an aqueous preparation which contains a disperse dye, an anionic polyadduct as defined herein and optionally a thickener and acid, and squeezing it out to the desired content of impregnating liquor of 60 to 120% of the weight of the fibre with subsequent heat treatment, e.g. steaming at temperatures of 98° to 105° C with neutral saturated steam or thermofixation at 180° to 210° C.

Level and strong dyeings which are characterised in addition by good fastness to rubbing and dye yields are obtained on synthetic organic fibrous material, especially on linear polyester fibres, according to the process of the invention.

In the following manufacturing directions and Examples, which illustrate the invention in more detail, the parts and percentages are by weight.

MANUFACTURING DIRECTIONS

A. 100 g of pure polypropylene glycol with an average molecular weight of 2000 are heated to 60° C. Then 20 g of urea and 20 g of sulphamic acid are addded with stirring over the course of 30 minutes. Stirring is continued for 30 minutes at 60°–65° C, the batch is then heated to 95° C and kept for 10 hours at 95° to 100° C. A viscous, yellowish product is obtained which dissolved to give a clear solution in water and contains 80% of the ammonium salt of the disulphuric acid ester.

B. 62 g of the condensation product of glycerol and propylene oxide with an average molecular weight of 3100 are treated as described in A with 6.4 g of urea and 6.4 g of sulphamic acid. A viscous product is obtained which is readily soluble in water and contains 92% of the ammonium salt of the sulphuric acid ester.

C. 75 g of the adduct of trimethylol propane and propylene oxide with an average molecular weight of 2540 are reacted as described in A with 9.6 g of sulphamic acid in the presence of 9.6 g of urea. A viscous, sulphated product is obtained which is readily soluble in water.

D. 100 of a maleic acid half ester of the formula

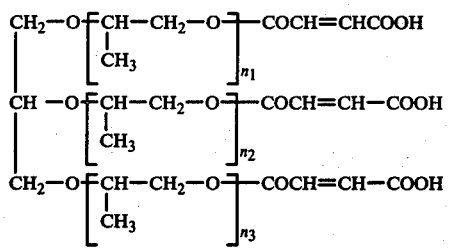

$n_1 + n_2 + n_3$ = c. 63, molecular weight c. 4000, with the addition of 7.12 g of sodium metabisulphite in 400 ml of water are stirred for 9 hours under reflux, in the course of which the pH of the reaction mixture is kept between 5.5 and 6.5 with 7.5 ml of a 10% aqueous sodium hydroxide solution. A slightly yellowish, opaque solution is formed which has a degree of addition of 100%, ascertained from the non-reacted amount of sulphite. After evaporation at 40°–50° C there are obtained 109 g of the sodium salt of the sulphosuccinic acid half ester in the form of a highly hygroscopic, tacky substance.

E. 100 g of the condensation product with an average molecular weight of 4000 obtained from glycerol and propylene oxide are heated to 60° C. Then 10 g of urea and 10 g of sulphamic acid are added in 15 and in 30 minutes respectively. After further stirring at 60°–65° C for 30 minutes, the batch is heated to 100° C and kept for one hour at 100° C and for a further 9 hours at 105° C. The resultant sulphation product dissolved to give a clear solution in water.

F. The procedure of Direction E is carried out, except that 100 g of a condensation product with an average molecular weight of 6000 obtained from glycerol and propylene oxide are used.

G. 100 g of polypropylene glycol (average molecular weight 1000) are esterified in the same way as in Direction E with 40 g of sulphamic acid in the presence of 40 g of urea. The resultant reaction product contains 66% of the ammonium salt of the acid sulphuric acid ester and dissolves to give a clear solution in water.

H. 47.6 g of the adduct of 1 mole of ethylene glycol and 40 moles of propylene oxide (average molecular weight 2380) are esterified in the same way as in Direction E in the presence of 8 g of urea with 8 g of sulphamic acid.

I. 40 g of the product obtained according to Direction B are mixed at 60° C with 10 g of adipic acid di-2-ethylhexyl ester and then with 0.5 g of the adduct of 1 mole of castor oil and 40 moles of ethylene oxide, 3 g of water and 2.5 g of isopropanol. A liquid, homogeneous product is obtained. A fine emulsion of the adipic acid ester results after the product has been dissolved in water.

K. 37 g of the product obtained according to Direction B are mixed with 3 g of monoethanolamine and then with 50 g of benzene. Benzene and ammonia are driven off in vacuo, whereupon the monoethanolamine salt of the acid sulphuric acid ester of the condensate of glycerol and propylene oxide of average molecular weight 3100 is obtained.

L. The procedure of Direction K is carried out, except that 5 g of triethanolamine are used instead of monoethanolamine. The corresponding triethanolamine salt is obtained.

M. 50 g of the product obtained according to Direction B are treated with 50 g of water and 0.8 g of an aqueous emulsion of methylpolysiloxane is added to the resultant clear solution.

EXAMPLE 1

25 g of a polyethylene glycol terephthalate knitted fabric are treated for 10 minutes at 60° C in a circulation dyeing apparatus with a liquor which contains 0.6 g of ammonium sulphate and 0.3 g of an assistant mixture consisting of 55 parts of the sulphuric acid ester obtained according to Manufacturing Direction B, 10 parts of adipic acid di-2-ethylhexyl ester and 35 parts of water and isopropanol (1:1) in 300 ml of water, and which is adjusted to pH 5.5 with 85% formic acid. Subsequently 1.35 g of a dyestuff mixture consisting of 0.875 g of a dye of the formula

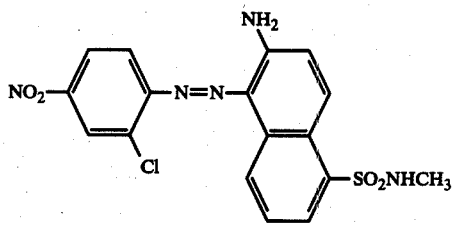

(1)

and 0.475 g of a dye of the formula

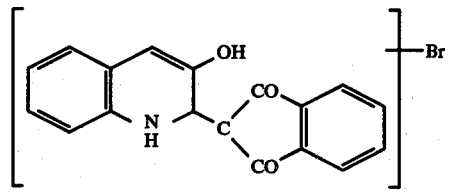

(2)

are added to the liquor and the dyebath is heated over the course of 30 minutes to 130° C. Dyeing is performed for 60 minutes at this temperature and the liquor is cooled to 90° C. The resultant dyeing is rinsed and dried. A level, brilliant, red dyeing is obtained.

EXAMPLE 2

400 g of a wound package of polyethylene glycol terephthalate fibres are treated for 10 minutes at 60° C in a circulation dyeing apparatus with a liquor which contains 16 g of ammonium sulphate and 8 g of the disulphuric acid ester obtained according to Manufacturing Direction A, dissolved in 8 liters of water, and which is adjusted to pH 5.5 with 85% formic acid. Then 1 g of a dyestuff mixture consisting of 0.4 g of a dye of the formula

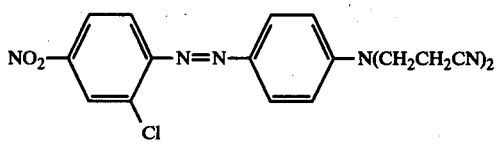

(3)

0.2 g of a dye of the formula

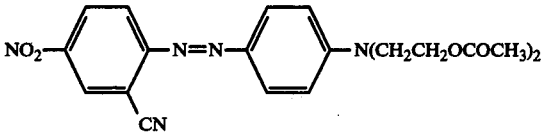

(4)

and 0.4 g of a dye of the formula

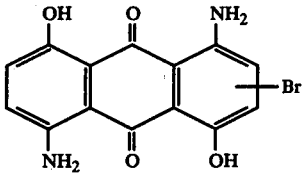

(5)

is added and the dyebath is heated over the course of 30 minutes to 130° C. Dyeing is performed for 60 minutes at this temperature and the bath is then cooled to 90° C and the resultant dyeing is subsequently rinsed and dried. A level grey dyeing is obtained.

EXAMPLE 3

Level dyeings are also obtained by substituting for the assistants used in Examples 1 or 2 equal amounts of a further assistant consisting of 80 parts of the sulphuric acid ester obtained according to Manufacturing Direction B and 20 parts of the condensation product obtained from stearyl alcohol and 1 mole of ethylene oxide and otherwise carrying out the procedure as described therein.

EXAMPLE 4

Level dyeings are also obtained by substituting for the assistants used in Examples 1 or 2 equal amounts of a further assistant consisting of 60 parts of the sulphuric acid ester obtained according to Manufacturing Direction B and 40 parts of butyl alcohol and otherwise carrying out the procedure as described therein.

EXAMPLE 5

Level dyeings are also obtained by substituting for the assistants used in Examples 1 or 2 equal amounts of an assistant consisting of 80 parts of the sulphuric acid ester obtained according to Manufacturing Directin B and 20 parts of a mixture of 5% silicone oil and 95 % 2-ethylhexanol and otherwise carrying out the procedure as described therein.

EXAMPLE 6

A level dyeing is also obtained by substituting 2.2 g of the sulphuric acid ester obtained according to Manufacturing Direction C and 0.13 g of adipic acid 2-ethylhexyl ester for the assistant mixture used in Example 1 and otherwise carrying out the procedure as described therein. Similar results are obtained by using the sulphosuccinic acid half ester obtained according to Manufacturing Direction D instead of the assistant obtained according to Manufacturing Direction C.

EXAMPLE 7

Level dyeings which are fast to rubbing are also obtained by substituting 8 g of the product according to Manufacturing Direction I or 16 g of the product according to Manufacturing Direction M for the product obtained according to Manufacturing Direction A and used in Example 2, or by substituting 0.3 g of the product according to Manufacturing Direction I or 0.6 g of the product according to Manufacturing Direction M for the assistance mixture used in Example 1.

EXAMPLE 8

Level dyeings are also obtained with the products obtained according to Manufacuring Directions E, F, G, H, K, L, by using these in corresponding amounts instead of the product of Manufacturing Direction B according to Example 1.

EXAMPLE 9

40 g of a polyethylene terephthalate staple fibre wovenfabric are dyed in a dyeing apparatus for 16 minutes at 130° C by agitating the goods in a liquor (liquor ratio 1:9) which contains 0.5% (based on the weight of the fabric) of a 20% aqueous dispersion of the fluorescent brightener of the formula

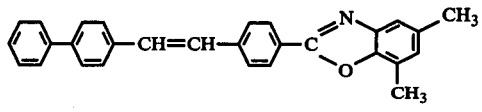

(6)

and 5 g per liter of the preparation according to Manufacturing Direction I. The bath is drawn off at 130° C. The fabric, which is rinsed and dried in the customary manner, has a very pronounced, brilliant white effect with neutral shade of complete levelness. A dyeing in which there used 4.0 g of a 25% aqueous solution of the levelling agent of the formula $$C_{17}H_{35}CH_2O - (C_2\text{-}CH_2O)_{35}\text{-}H$$

per liter instead of 0.5 g of the preparation according to Manufacturing Direction I yields under otherwise similar conditions a substantially poorer whitening of insufficient levelness. In places even green discolourations caused by undeveloped brightener are observed on the treated fabric.

EXAMPLE 10

A polyethylene terephthalate staple fibre fabric is padded in a liquor which contains per lire 5 g of a 20% aqueous dispersion of the fluorescent brightener of the formula

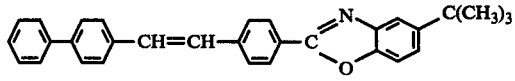

(7)

and 2.5 g of the preparation according to Manufacturing Direction I (Pick-up 50%). The dyeing is subsequently dried at 60° C and then fixed for 30 seconds at 190° C. A brilliant, very pronounced white effect is obtained. A similar dyeing without addition of the preparation according to Manufacturing Direction I yields a fabric which is only insufficiently whitened and of a greenish colour on account of incompletely developed brightener. The fluorescent brightener is fully developed only at a temperature of 210° C but without attaining the effect of a fluorescent whitening carried out with the product according to Manufacturing Direction I and also fixed at 210°. In the same way, it is possible to lower the fixation temperature of a combination of the fluorescent brighteners of the formulae

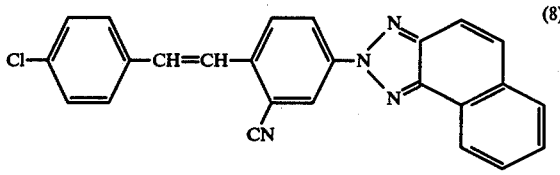

(8)

and

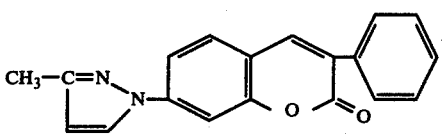

(9)

from190° to 170° C by the use of the product according to Manufacturing Direction I.

EXAMPLE 11

25 g of a polyethylene glycol terephthalate knitted fabric, wound on a perforated metal carrier, are treated for 10 minutes at 60° C in a circulation apparatus with a liquor which contains 0.6 g of ammonium sulphate and 0.3 g of an assistant mixture consisting of 55 parts of the sulphuric acid ester obtained according to Manufacturing Direction B, 10 parts of adipic acid di-2-ethyl-hexyl ester and 35 parts of water and isopropanol (1:1) and 1.5 g of a carrier of the type trichlorobenzene/diphenyl in 300 ml of water, and which is adjusted to pH 5.5 with 85% formic acid. Then 0.625 g of a dye of the formula

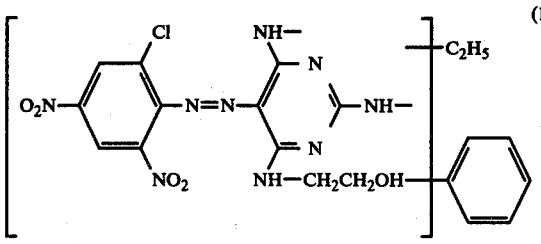

(10)

is added to this liquor and the dyebath is heated to 98° C over the course of 30 minutes. Dyeing is performed for 60 minutes at this temperature and the liquor is afterwards cooled to 90 C. The resultant dyeing is rinsed and dried. A level brilliant, red dyeing is obtained with no precipitation of dye on the inside of the carrier.

EXAMPLE 12

10 g of polyacrylonitrile fabric are treated for 10 minutes at 60° C in a dyeing apparatus with a liquor which contains 0.8 g of an assistant mixture consisting of 55 parts of the sulphuric acid ester according to Manufacturing Direction B, 10 parts of adipic acid di-2-ethyl-hexyl ester and 35 parts of water and isopropanol (1:1) in 400 ml of water, and which is adjusted to pH 5.5 with 80% acetic acid. Then 0.05 g of a dye of the formula

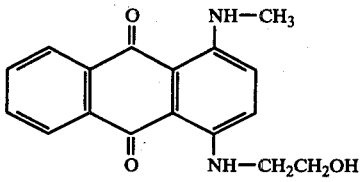

(11)

is added and the dyebath is heated to 98° C over the course of 30 minutes. Dyeing is carried out for 60 minutes at this temperature and the bath is cooled to 60° C. The resultant dyeing is rinsed and dried. A level light blue dyeing which is fast to rubbing is obtained.

EXAMPLE 13

In a high temperature dyeing aparatus, 5 g of a triacetate fabric are put into a liquor which contains 0.2 g of an assistant mixture consisting of 55 parts of the sulphuric acid ester obtained according to Manufacturing Direction B, 10 parts of adipic acid di-2-ethyl-hexyl ester and 35 parts of water and isopropanol (1:1) in 200 ml of water, as well as 0.05 g of the dye of the formula (11) used in Example 12, and which is adjusted to pH 5.5 with 80% acetic acid. The dyebath is then heated to 125° C over the course of 45 minutes. Dyeing is carried out for 30 minutes at this temperature and the bath is subsequently cooled to 80° C. The resultant dyeing is rinsed and dried in the usual way. A level, brilliant, blue dyeing which is fast to rubbing is obtained.

EXAMPLE 14

0.1 g of a disperse dye of the formula

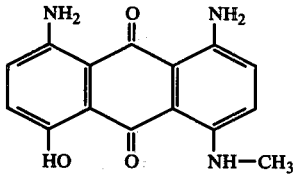

(12)

is stirred into 300 ml of water which contains 0.15 g of an assistant mixture consisting of 55 parts of the sulphuric acid ester obtained according to Manufacturing Direction B, 10 parts of adipic acid di-2-ethyl-hexyl ester, and 35 parts of water and isopropanol (1:1). The dyebath is then, as is customary in dyeing, heated to 98° C over the course of 30 minutes and held for 10 minutes at this temperature. After it had been cooled, the dyebath was drawn off through a round filter in order to ascertain any dyestuff agglomeration. Even after this treatment the dyestuff dispersion was still intact andd no deposits caused by agglomeration was observed.

EXAMPLE 15

10 g of a polyethylene glycol terephthalate/wool blended fabric (50:50) are treated in a dyebath with a liquor which contains 0.8 g of ammonium sulphate and 0.8 g of an assistant mixture consisting of 55 parts of the sulphuric acid ester obtained according to Manufacturing Direction B, 10 parts of adipic acid di-2-ethyl-hexyl ester and 35 parts of water and isopropanol (1:1) in 400 ml of water, as well as 0.2 g of the disperse dye of the formula

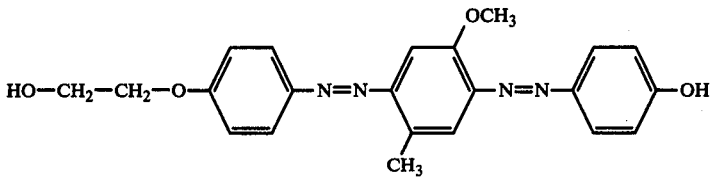

(13)

and which is adjusted with 80% acetic acid to a pH of 5.5. The dyebath is heated to 98° C over the course of 30 minutes while constantly agitating the fabric. Dyeing is effected for 60 minutes at this temperature and the fabric is subsequently rinsed and dried as usual.

A strong dyeing is obtained on the polyester portion of the treated fabric and a distinct reserve on the wool portion.

EXAMPLE 16

Polyacrylonitrile piece goods are slop padded to 100 percent by weight liquor pick-up with an aqueous liquor which contains per liter:

5 g of the disperse dye used in Example 12 of the formula (11)

6 g of starch ether 5 g of the assistant mixture consisting of 55 parts of the sulphuric acid ester obtained according to Manufacturing Direction B, 10 parts of adipic acid di-2-ethylhexyl ester and 35 parts of water and isopropanol (1:1) and the pH of which is adjusted to 5.5 with acetic acid.

Without first drying them, the treated goods are then treated in a steamer for 30 minutes at 105° C (saturated steam) and afterwards rinsed and dried in the usual way. A brilliant, level, light blue dyeing which is fast to rubbing is obtained.

EXAMPLE 17

10 g of a texturised polyethylene glycol terephthalate fabric are treated for 10 minutes at 60° C in a dyeing apparatus with a liquor which contains 0.24 g of ammonium sulphate and 0.24 g of an assistant according to Manufacturing Instruction I in 120 ml of water and which is adjusted to a pH of 5.5 with 85% formic acid. The liquor is then heated to 135° C over the course of 35 minutes and then 0.018 g of a dye of the formula

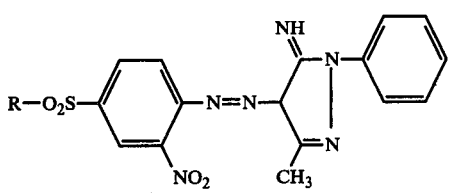

(14)

R = $CH_3$ and $C_2H_5$ (1:1)

0.015 g of a dye of the formula

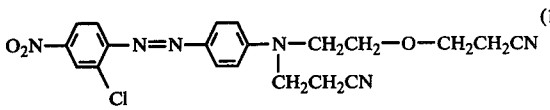

(15)

and 0.015 g of a dye of the formula

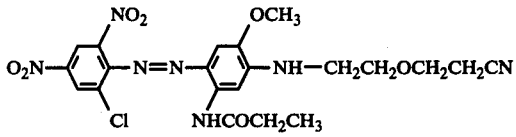

(16)

are added. Dyeing is carried out for 30 minutes at this temperatue and the bath is then cooled to 90° C. The resultant dyeing is rinsed and dried. A level, grey dyeing is obtained.

EXAMPLE 18

Texturised polyethylene terephthalate fabric is impregnated at 20° to 30° C with an impregnating liquor which contains 29 g/l of a dye of the formula

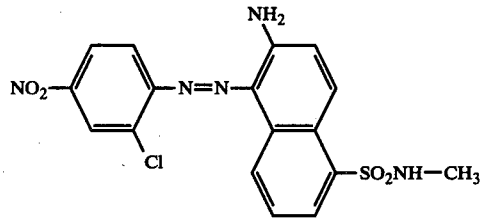

(17)

10 g/l of an assistant according to Manufacturing Direction I 2 g/l of alginate thickener 0.5 g/l of sodium alkylnaphthalenesulphonate and 2 g/l of monosodium phosphate and which is adjusted to a pH of 6.5 with acetic acid. The fabric is subsequently squeezed out to 98% liquor pick-up, based on the dry weight of the goods, dried at 120° C for 3 minutes and thermofixed at 190° C for 45 seconds. The dyeing is washed with cold water and dried. A level, red dyeing is obtained. If appropriate, it is also possible to carry out the customary reductive aftertreatment after rinsing.

We claim:

1. A process for dyeing synthetic textile fibers with a dye that is sparingly soluble to insoluble in water, comprising the step of applying to the textile fibers an aqueous liquor containing the dye and a water-soluble acid ester of a polypropyleneoxide adduct of an average molecular weight of 1000 to 6000, wherein the polypropyleneoxide adduct is an adduct from reactants selected from the group consisting of propyleneoxide and a polyhydric aliphatic alcohol selected from the group consisting of ethyleneglycol, 1,3-propylene glycol, 1,2-propylene glycol, 1,5-pentane diol, glycerol and trimethylol propane, and wherein the acid ester of the poly-propyleneoxide addut is a free acid or an alkali metal salt or ammonium salt of an acid ester of the polypropyleneoxide adduct and sulfuric acid, or sulfaminic acid.

2. The process of claim 1, wherein the poly-hydric aliphatic alcohol is 1,3-propylene glycol, 1,2-propylene glycol, 1,5-pentane diol,glycerol or trimethylol propane.

3. The process of claim 2, wherein the acid ester is an alkali metal or ammonium salt of the acid ester of the polypropyleneoxide adduct and sulfuric acid.

4. The process of claim 3, wherein the poly-hydric aliphatic alcohol is propylene glycol or glycerol.

5. The process of claim 4, wherein the acid ester of the polypropyleneoxide adduct is the ammonium salt.

6. The process of claim 5, wherein the polyhydric aliphatic alcohol is glycerol.

7. The process of claim 1 wherein the acid ester of the polypropyleneoxide adduct has an average molecular weight of 2000 to 3500.

8. The process of claim 1, wherein the aqueous liquor contains 0.1 to 5 g of the acid ester of the polypropylene-oxide adduct per liter of liquor.

9. The process of claim 1, wherein the aqueous liquor further contains an antifoaming agent.

10. The process of claim 9, wherein the antifoaming agent is adipic acid di-2-ethyl-hexyl ester.

11. The process of claim 1, wherein the aqueous liquor is applied to the textile fibers by exhaustion dying 12. The process of claim 1, wherein the synthetic textile fibers are synthetic linear polyester fibers.

13. The process of claim 1, wherein the aqueous liquor is applied to the textile fibers at a temperature of 110 to 140° C.

14. A dye liquor for dyeing synthetic textile fibers, said liquor containing water, at least one dye which is sparingly soluble to insoluble in water, and a water-soluble acid ester of a polypropyleneoxide adduct of an average molecular weight of 1000 to 6000, wherein the polypropyleneoxide adduct is an adduct from reactants selected from the group consisting of propyleneoxide and a polyhydric aliphatic alcohol selected from the group consisting of ethyleneglycol, 1,3-propylene glycol, 1,2-propylene glycol, 1,5-pentane diol, glycerol and trimethylol propane, and wherein the acid ester of the poly-propyleneoxide adduct is a free acid or an alkali metal salt or ammonium salt of an acid ester of the polypropyleneoxide adduct and sulfuric acid, or sulfaminic acid.

* * * * *